US005335490A

United States Patent [19]

Johnson et al.

[11] Patent Number: 5,335,490

[45] Date of Patent: Aug. 9, 1994

[54] THRUST AUGMENTOR HEAT SHIELD

[75] Inventors: Kenneth L. Johnson, Cincinnati; Mark S. Zlatic, Wyoming; Leonard P. Grammel, Jr., Cincinnati, all of Ohio; John A. Manteiga, North Andover, Mass.

[73] Assignee: General Electric Company, Cincinnati, Ohio

[21] Appl. No.: 84,886

[22] Filed: Jun. 30, 1993

Related U.S. Application Data

[63] Continuation-in-part of Ser. No. 816,000, Jan. 2, 1992, abandoned.

[51] Int. Cl.[5] ..... F02K 3/10

[52] U.S. Cl. ..... 60/261; 60/740; 60/749

[58] Field of Search ..... 60/261, 264, 266, 738, 60/740, 749, 39.11, 39.83, 39.31

[56] References Cited

U.S. PATENT DOCUMENTS

| | | | |
|---|---|---|---|
| 2,766,963 | 10/1956 | Zimmerman | 253/78 |
| 2,861,424 | 11/1958 | Jurisich | 60/39.72 |
| 3,646,763 | 3/1972 | Arand | 60/39.31 |
| 3,780,529 | 12/1973 | Johnson | 60/39.36 |
| 3,800,530 | 4/1974 | Nash | 60/261 |
| 3,879,940 | 4/1975 | Stenger et al. | 60/740 |
| 4,064,691 | 12/1977 | Nash | 60/39.06 |
| 4,312,185 | 1/1982 | Nash et al. | 60/261 |
| 4,426,191 | 1/1984 | Brodell et al. | 415/189 |
| 4,431,373 | 2/1984 | Monsarrat | 415/189 |
| 4,706,453 | 11/1987 | Vivace | 60/261 |
| 4,730,453 | 3/1988 | Benoist et al. | 60/261 |
| 4,751,815 | 6/1988 | Moore | 60/261 |
| 4,899,539 | 2/1990 | Gastebois et al. | 60/261 |
| 4,901,527 | 2/1990 | Nash et al. | 60/261 |
| 4,987,736 | 1/1991 | Ciokajlo et al. | 60/39.31 |
| 4,989,407 | 2/1991 | Grant, Jr. | 60/261 |
| 5,022,805 | 6/1991 | Roberts | 60/261 |
| 5,022,816 | 6/1991 | Maier et al. | 415/115 |
| 5,031,407 | 7/1991 | Zaremba et al. | 60/739 |
| 5,069,034 | 12/1991 | Jourdain et al. | 60/39.31 |
| 5,079,915 | 1/1992 | Veau | 60/261 |
| 5,131,813 | 7/1992 | Przytulski et al. | 416/217 |

FOREIGN PATENT DOCUMENTS 2636378 3/1990 France .

*Primary Examiner*—Louis J. Casaregola
*Assistant Examiner*—Howard R. Richman
*Attorney, Agent, or Firm*—David L. Narciso; Jerome C. Squillaro

[57] ABSTRACT

A thrust augmentor heat shield for enclosing radially extending fuel pipes which can be attached to and removed from the outer duct wall from within the augmentor. The heat shield includes a hollow, elongate housing extending substantially entirely along the length of the fuel pipe, a nose projecting forwardly from the housing and received within a slot formed in the duct wall and a bolt for clamping the housing to the duct wall and urging the nose of the housing into the slot. The housing includes an opening between the outer duct wall and the diffuser wall for conveying cooling air radially inwardly along the housing, and openings along lateral sides of the housing in registry with the fuel discharge ports of the fuel tube. The housing includes a diffuser flowpath segment such that, when the housings are arranged in a spoke pattern, the segments form a continuous annular wall joined by splined connections. In an alternate embodiment, the outer duct wall includes a strut which extends from the duct wall to the diffuser wall and the housing is connected to it by a bolt and nose connection. With other embodiments, the housing connection includes a wedge-shaped cam mounted on the diffuser wall which jams against a correspondingly-shaped flared upper end of the housing. Another embodiment includes a collar contiguous with the diffuser wall and extended shank shoulder bolts for installation from inside the augmentor through the collar.

20 Claims, 6 Drawing Sheets

THRUST AUGMENTOR HEAT SHIELD

The government has rights in this invention pursuant to contract No. F33657-83C-0281 awarded by the Department of the Air Force and contract No. N00019-91C-0114 awarded by the Department of the Navy.

This application is a continuation-in-part application of U.S. patent application Ser. No. 07/816,000 for a Thrust Augmentor Heat Shield, filed on Jan. 2, 1992, now abandoned.

BACKGROUND OF THE INVENTION

The present invention relates to thrust augmentors for gas turbine engines and, more particularly, to heat shield designs for the fuel pipes of such thrust augmentors.

A typical jet aircraft engine configuration is shown schematically in FIG. 1A and is referred to generally as 11, with an engine axis 17. Engine 11 includes a turbine engine section 31 generally defined by arrows A, and a thrust augmentor 12 generally defined by arrows B. The gas flow path through the engine is represented by arrows C.

In order to increase the thrust temporarily of a gas turbine engine, a thrust augmentor is used. Such thrust augmentors are located downstream of the core engine and include a substantially cylindrical diffuser wall which defines the augmentor or afterburner channel, and a plurality of fuel tubes 33 projecting radially inwardly toward the axis 17, into the augmentor channel for injecting fuel into the hot exhaust gases of the core engine.

Examples of such thrust augmentors are disclosed in Nash et al., U.S. Pat. No. 4,901,527 and Gastebois et al., U.S. Pat. No. 4,899,539. Nash et al. discloses a thrust augmentor including fuel injectors extending radially inwardly through an outer casing and diffuser wall into the augmentor channel. Fairings surround the injectors, shielding the fuel pipes from heat from the hot core gas flow and downstream flame in the augmentor, and include an opening for directing cooling air from the bypass channel through the fairing to further protect the fuel pipes from the surrounding heat of the augmentor. Gastebois et al. discloses a thrust augmentor having a plurality of tubular injectors concentric with an outer sleeve which directs cooling air trapped by an air scoop in the bypass air duct, along the length of the fuel tube, thus also acting as a heat shield. The fuel tube is within a V-shaped flame stabilizer which opens downstream of the fuel tube. The fuel tube includes a plurality of orifices arranged along its length and which open in an upstream direction, so that fuel issues in counterflow fashion of the flame stabilizer.

A disadvantage with such designs is that it is often difficult to replace damaged heat shields. Disconnecting such heat shields from the supporting structure for replacement typically requires removal of the engine from an aircraft to gain access to attachment means from outside the augmentor channel. Consequently, aircraft availability is affected and engine downtime is increased. Accordingly, there is a need for a thrust augmentor heat shield which can be accessed from within the thrust augmentor channel and replaced without requiring access outside the outer wall of the channel.

SUMMARY OF THE INVENTION

The present invention is a thrust augmentor heat shield in which the heat shield is attached to the outer duct wall of the bypass air channel by a mechanism which is completely accessible from within the augmentor channel. In a preferred embodiment, the heat shield includes a housing which extends along the length of the fuel tube and includes a forwardly projecting nose which is received within a slot formed in the outer duct wall and a bolt which threads into the duct wall. The bolt is oriented such that tightening down on the bolt urges the nose of the housing into the slot. Consequently, the entire heat shield assembly can be attached or removed by actuating the bolt.

Also in the preferred embodiment, the heat shield includes a diffuser flowpath segment which is oriented to be contiguous with the diffuser wall adjacent to the heat shield. In an engine design in which a plurality of fuel tubes are employed and are arranged in a spoke fashion, the diffuser flowpath segments combine to form a continuous, annular shell and abut each other with splined connections.

In order to form a seal between the diffuser flowpath segment of the heat shields of such an embodiment and the diffuser wall, a leaf seal is employed. The leaf seal is mounted on the diffuser wall and includes a leaf portion which resiliently engages the diffuser flowpath segment and seals the seam between the segment and the diffuser wall.

It is also preferred to utilize a diffuser flowpath segment which is a thin plate of sheet steel which includes stiffening ribs. The stiffening ribs are arranged to modify the natural vibration frequency of the segment such that it falls outside of the maximum engine operating speed, typically in excess of 10,000 RPM.

In an alternate embodiment, the housing includes a flared frustoconical upper end which engages a wedge-shaped recess at a forward end and a wedge-shaped cam at an aft end. The block is attached to a bolt which is threaded through a guide attached to the outer duct wall. In yet another embodiment, the bolted connection includes a lug carried on the bolt which engages an aft extending flange.

In a further embodiment, the duct wall includes a cylindrical strut which extends to the diffuser wall and is connected to the housing by the bolted connection. In yet a further embodiment, the heat shield is inserted through a hole in the diffuser liner and attached to the outer duct wall by extended shank shoulder bolts. The bolts extend through a collar separating the bypass flow from the hot core gas flow. In all the embodiments, the portion of the heat shield or cylindrical strut extending between the duct wall and diffuser wall includes an upstream facing opening which acts as a scoop to direct cooling air radially inwardly along the length of the housing to cool the fuel tube. Also, in all the embodiments, the bolted connection is completely accessible from within the augmentor channel.

Accordingly, it is an object of the present invention to provide a heat shield for a thrust augmentor which is completely accessible from within the augmentor channel; a heat shield which is relatively easy to fabricate; a heat shield which can be mounted within the engine or removed from the engine relatively easily; and a heat shield which directs cooling bypass air along the length of the fuel tube to maintain the fuel tube below the temperature within the augmentor.

Other objects and advantages will be apparent from the following description, the accompanying drawings and the appended claims.

DETAILED DESCRIPTION

Figure 1:
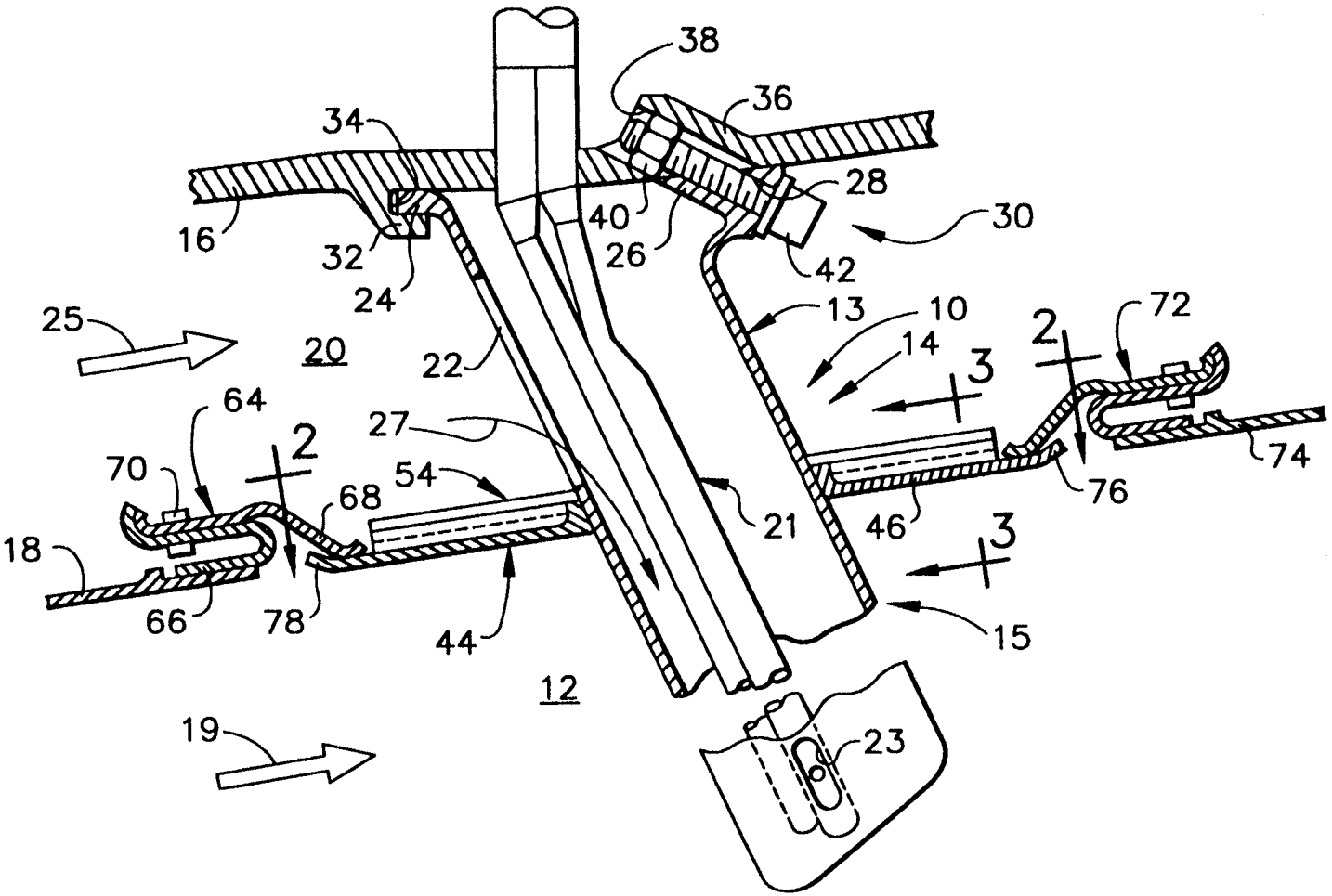
FIG. 1 is a partial side elevation, in section, of a heat shield of the present invention mounted in a gas turbine engine.
Figure 1A:
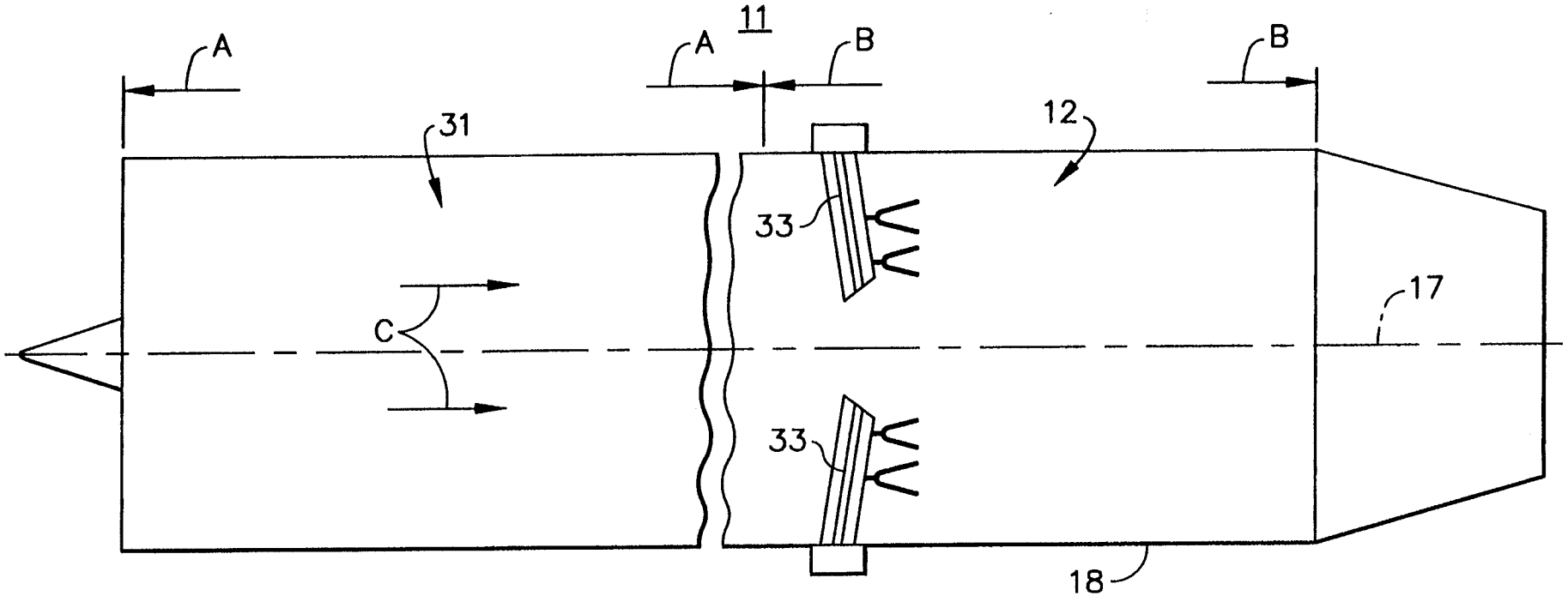
FIG. 1A is a schematic diagram of a typical gas turbine engine including a thrust augmentor.
Figure 2:
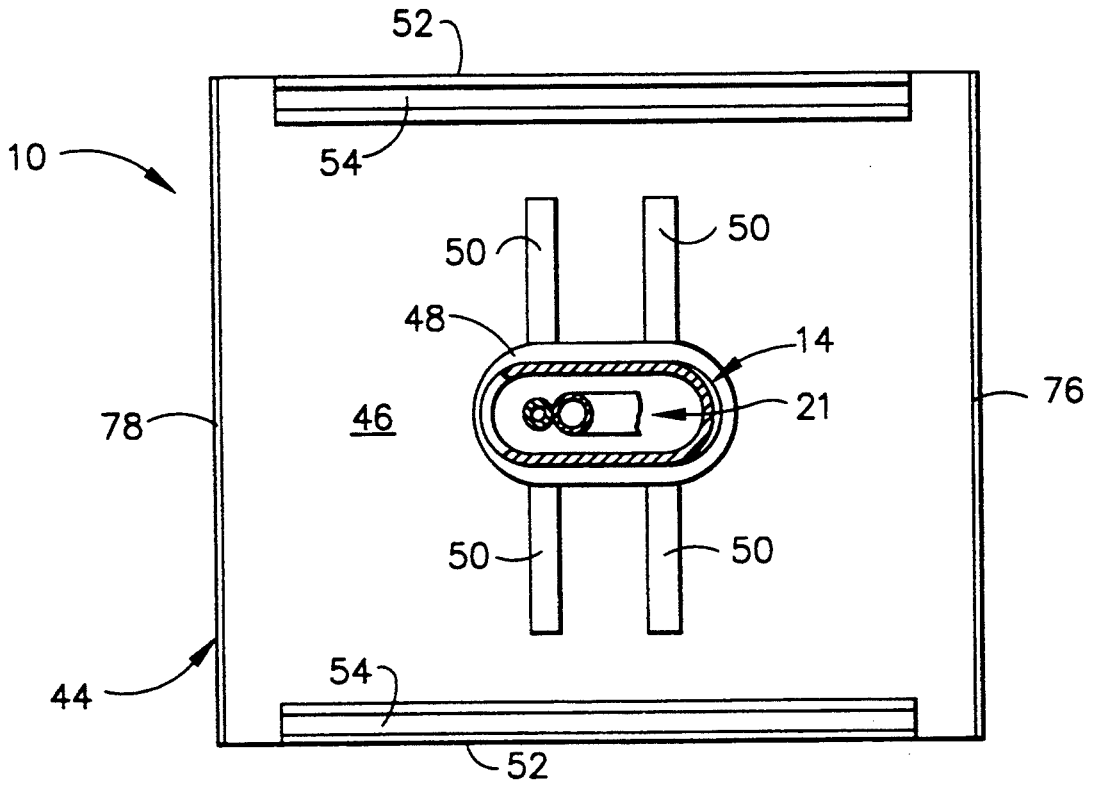
FIG. 2 is a top plan view of the heat shield taken along line 2—2 of FIG. 1.

As shown in FIGS. 1 and 2, a preferred embodiment of the heat shield of the present invention, generally designated 10, is positioned in the augmentor 12 of a gas turbine engine of a type similar to that described in U.S. Pat. No. 4,813,229, the disclosure of which is incorporated herein by reference, or other afterburning engines. The heat shield includes a housing 14 which is attached to the outer duct wall 16 and extends through the diffuser wall 18. The diffuser wall 18 defines the channel for the hot core gas flow 19 aft of the turbine, not shown, entering the augmentor 12. The outer duct wall 16 and diffuser wall 18 between them define a bypass duct 20 of conventional design for conveying cooling bypass air 25 rearwardly from the core engine.

The housing 14 has an oval, aerodynamic shape in cross-section (see FIG. 2), and is elongated in shape in elevation and encloses a substantially radially-inwardly extending fuel tube assembly 21 which also passes through the outer duct wall 16 and diffuser wall 18. The housing 14 has a first section 13 extending from the outer duct wall 16 to about the diffuser wall 18 and a second section 15 extending radially inwardly from the first section 13. Housing first section 13 includes a forward-facing opening 22 which forms a scoop for conveying a portion 27 of cooling air 25 from the bypass duct 20 along the interior of the housing 14. The housing includes elongated, oval openings 23, positioned along the lateral sides of the housing in registry with the side orifices of the fuel tube assembly 21. The openings 23 also allow cooling air to exit the housing 14. The openings are oval so that relative thermal expansion of the housing 14 will not result in the orifice of the fuel tube assembly 21 being blocked.

The housing 14 is generally oval in cross-section and includes a forwardly extending nose 24 and an aft end forming a boss 26 having a bore 28 for receiving a threaded bolt 30, which may be a self-retaining bolt. The outer duct wall 16 includes a lip 32 forming a slot 34 shaped to receive the nose 24. The outer duct wall 16 includes a boss 36 forming a bore 38 shaped to receive a nut 40 in a press fit. The bores 28, 38 are aligned and angled relative to the outer duct wall 16 such that tightening the bolt 30 forces the nose 24 into the slot 34. The bolt 30 includes a cap 42 which is seated on the boss 26 and clamps the boss 26 and housing 14 against the outer duct wall 16 when tightened.

Figure 3:
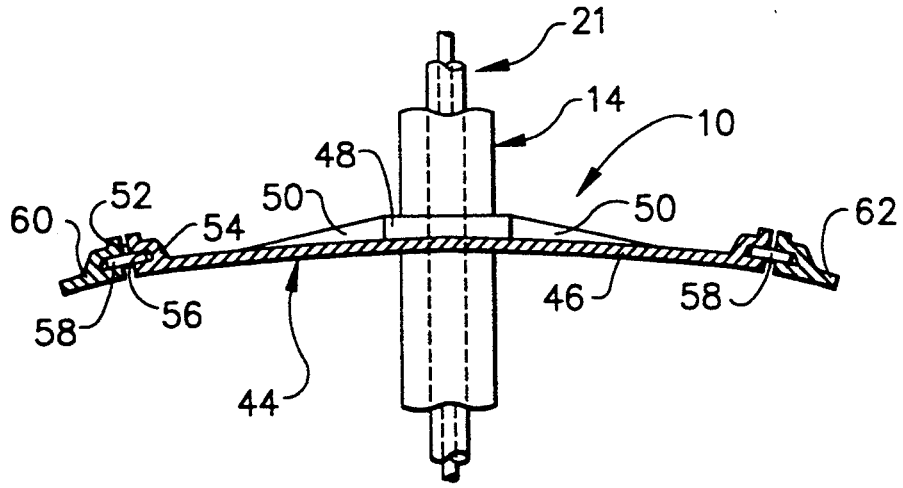
FIG. 3 is a rear elevation of the heat shield taken along line 3—3 of FIG. 1.

As shown in FIGS. 1, 2 and 3, the heat shield 10 includes a diffuser flowpath segment, generally designated 44. The diffuser flowpath segment 44 includes a substantially rectangular arcuate base plate 46 of sheet metal which is attached to the housing 14. The base plate 46 includes a raised collar 48 and a plurality of splayed ribs 50 extending outwardly from the collar. The ribs 50 act to stiffen the base plate 46 and change its vibration characteristics. The ribs 50 shown are sufficient to change the vibration characteristics of an unstiffened base plate 46 such that the first natural frequency of the base plate is above the highest engine speed. In practice, this would require that the natural frequency of the base plate exceed about 170 Hz for engines having a top speed of about 10,000 rpm.

As shown in FIG. 3, the axially-extending longitudinal edges 52 of the base plate 46 include raised ribs 54 forming slots 56. The slots 56 receive longitudinally extending spline seals 58 such that adjacent base plates 60, 62 are joined to base plate 46 by spline seals 58. The joints thus formed provide an air seal. In a preferred embodiment of the invention, there are approximately 32–36 heat shields 10 arranged in spoke fashion about the fuel pipes 21 of the augmentor 12 (FIG. 1). With this configuration, the diffuser flowpath segments 44 form a continuous ring and an extension of the diffuser wall 18. Spline seals 58 can be inserted laterally into slots 56 as the shields 10 are being installed for the first time. When a shield 10 is replaced and is abutted by adjacent shields, the spline 58 may be inserted into a slot through the aft leaf spring, as will be described below.

As shown in FIG. 1, the diffuser wall 18 includes a leaf seal 64 which forms a seal between the diffuser flowpath segment 44 and a contiguous portion of the diffuser wall 18. Each leaf seal 64 includes a base member 66 welded or brazed to an outer surface of the diffuser wall 18 and has a generally U-shaped cross-section. A plurality of leaf elements 68 are mounted on the base portion 66 by rivets 70. A second leaf spring assembly 72 is mounted on a continuation 74 of the diffuser wall 18 and forms a seal with the rearward transverse edge 76 of the base plate 46. The rearward transverse edge 76 and forward transverse edge 78 are slightly upturned to avoid projecting into the augmentor volume 12 and creating undesirable turbulence in the augmentor.

Figure 4:
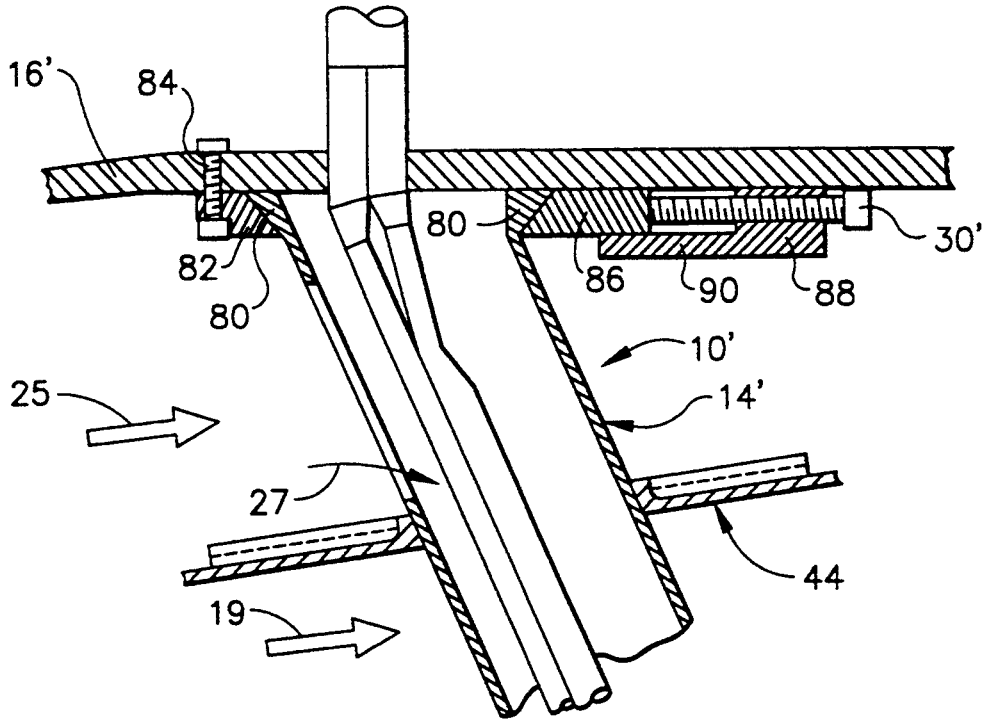
FIG. 4 is an alternate embodiment of the heat shield of the present invention.

As shown in FIG. 4, in an alternate embodiment of the heat shield 10′, the housing 14′ includes a flared, frustoconical upper end 80 which abuts the outer duct wall 16′. The front end of the upper end 80 is received within a wedge-shaped forward block 82 which is mounted on the wall 16′ by a nut and bolt combination 84. The rear portion of the frustoconical upper end 80 is engaged by a wedge-shaped cam 86 mounted on the end of a mounting bolt 30′ which is threaded through a boss 88 mounted on the wall 16′. The boss 88 includes an axially-extending guideway 90 which maintains proper orientation of the cam 86 relative to the upper end 80 and further, prevents deflection of the cam 86 away from the wall 16′.

Accordingly, the housing 14′ is mounted on the outer duct wall 16′ by tightening the bolt 30′ against the boss 88. This causes the cam 86 to jam against the aft portion of the frustoconical upper end 80 of the housing 14', which also urges the forward portion 80 against the block 82. Additional lateral support is effected by the inter-engagement of the diffuser flowpath segments 44 on the housings 14' of an array of heat shields 10'.

Figure 5:
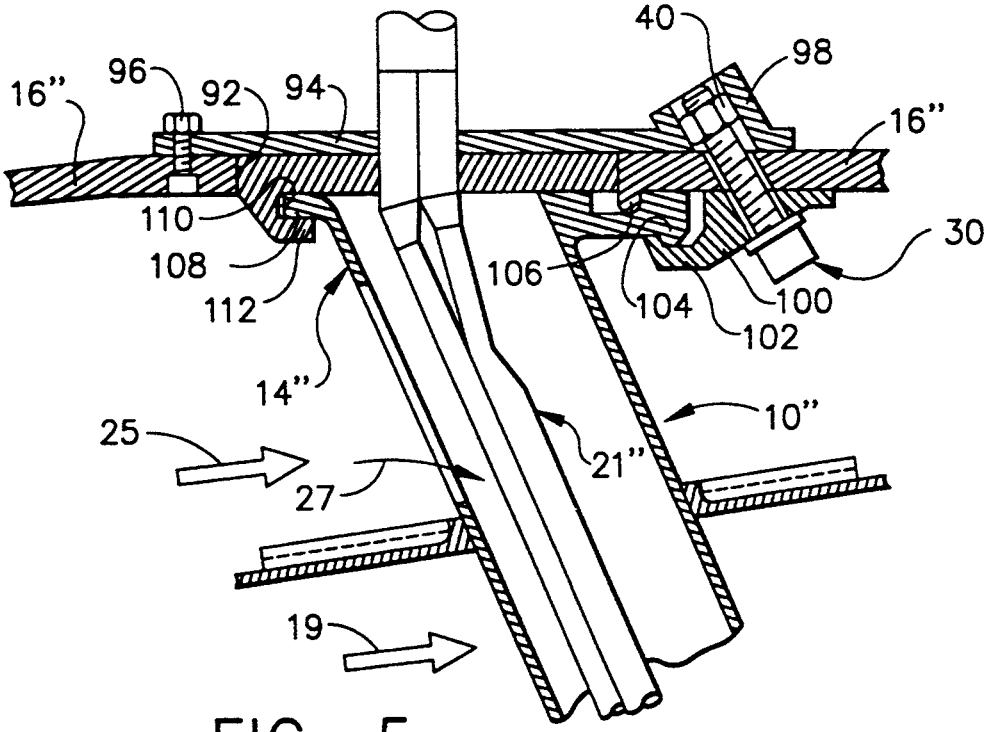
FIG. 5 is another alternate embodiment of the heat shield of the present invention.

Another alternate embodiment of the heat shield 10" is shown in FIG. 5. In this embodiment, the outer duct wall 16" includes an opening 92 which receives a fuel tube header 94 which is integral with the fuel tube 21". The forward end of the header 94 is attached to the duct wall 16" by a nut and bolt combination 96, and the aft end includes a boss 98 which receives a nut 40 in a press fit. The bolt 30 is threaded into the nut 40 and carries a lug 100 having a forward lip 102 which engages an aft extending flange 104 formed on the housing 14". The outer duct wall 16" includes a radially extending bead 106 which engages an undercut of the flange 104.

The housing 14" includes a forwardly projecting nose 108 which is received within a slot 110 formed by a lip 112 projecting radially inwardly from the header 94. The heat shield 10" is attached to the header 94 by inserting the nose 108 within the slot 110, then threading the bolt 30 into the nut 40, which causes the lug 100 to clamp against the flange 104. The bolt 30 also clamps the header 94 against the outer duct wall 16".

Figure 6:
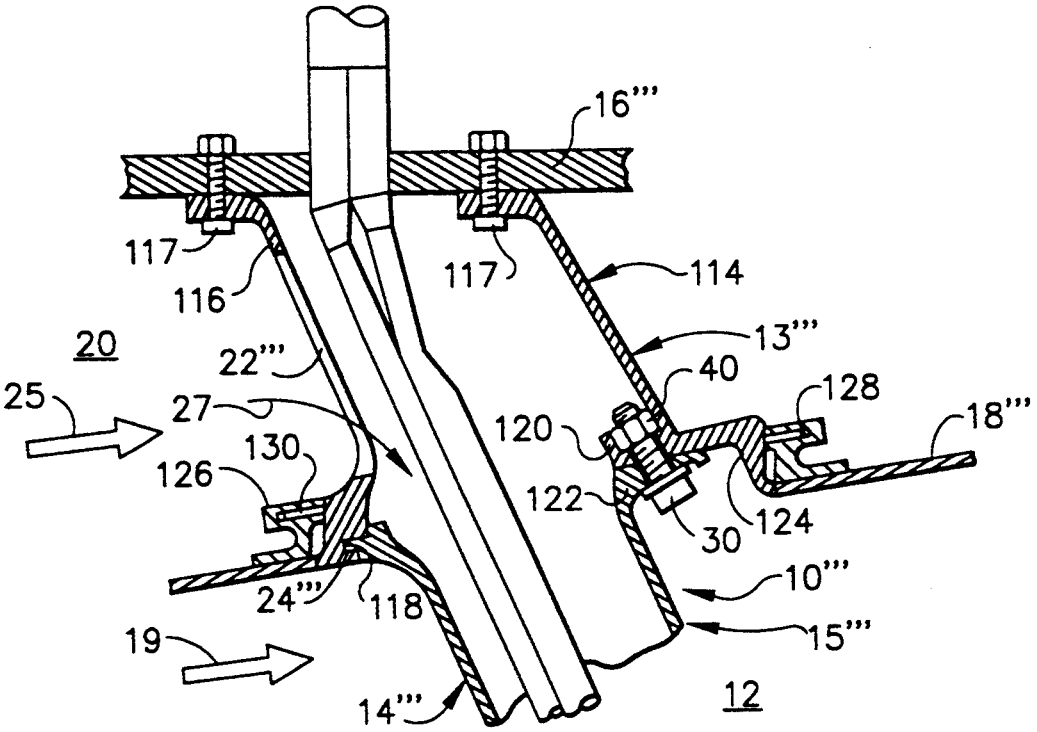
FIG. 6 is another alternate embodiment of the heat shield of the present invention.

Another embodiment of the heat shield 10''' is shown in FIG. 6. In this embodiment, the housing first section 13''' comprises a strut 114 having a body 116 which is attached to the outer duct 16''' by bolts 117 and includes, at its radially-inner end, a slot 118 at a forward end and a boss 120 at a rearward end which receives a nut 40. The strut 114 includes an opening 22''' for directing cooling air portion 27 from bypass duct 20 radially inwardly through strut 114 and housing 14'''. The housing 14''' second section 15''' of the heat shield 10''' includes a forwardly projecting nose 24''', which engages the slot 118 at a forward end, and a flange 122 at an aft end which receives the bolt 30 therethrough.

The end of the strut 114 is aligned with but not rigidly connected to the diffuser wall 18''', and includes an offset 124 which receives the bolt 30 so that the bolt does not project radially inwardly into the augmentor volume 12. A flange 126 is mounted on the outer surface of the diffuser wall 18''' and includes an inwardly-opening slot 128. An oval seal ring 130 is inserted in the slot 128 and is captured by the strut 114. In assembly, the strut 114 is inserted through the ring 130 and bolted to the outer duct wall 16''' by bolts 117. In this embodiment, housing first section 13''' transmits forces on the housing second section 15''' from the core gas flow 19 radially outwardly to the structure of the outer duct wall 16''' by means of strut 114.

Figure 7:
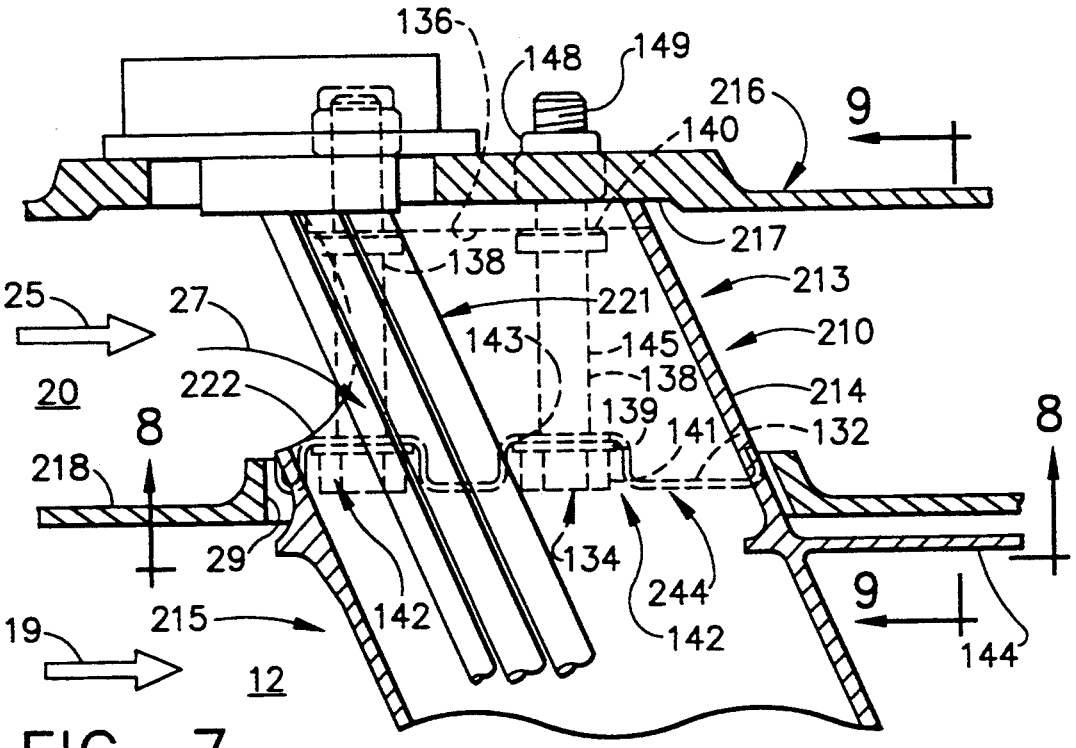
FIG. 7 is another alternate embodiment of the heat shield of the present invention.
Figure 8:
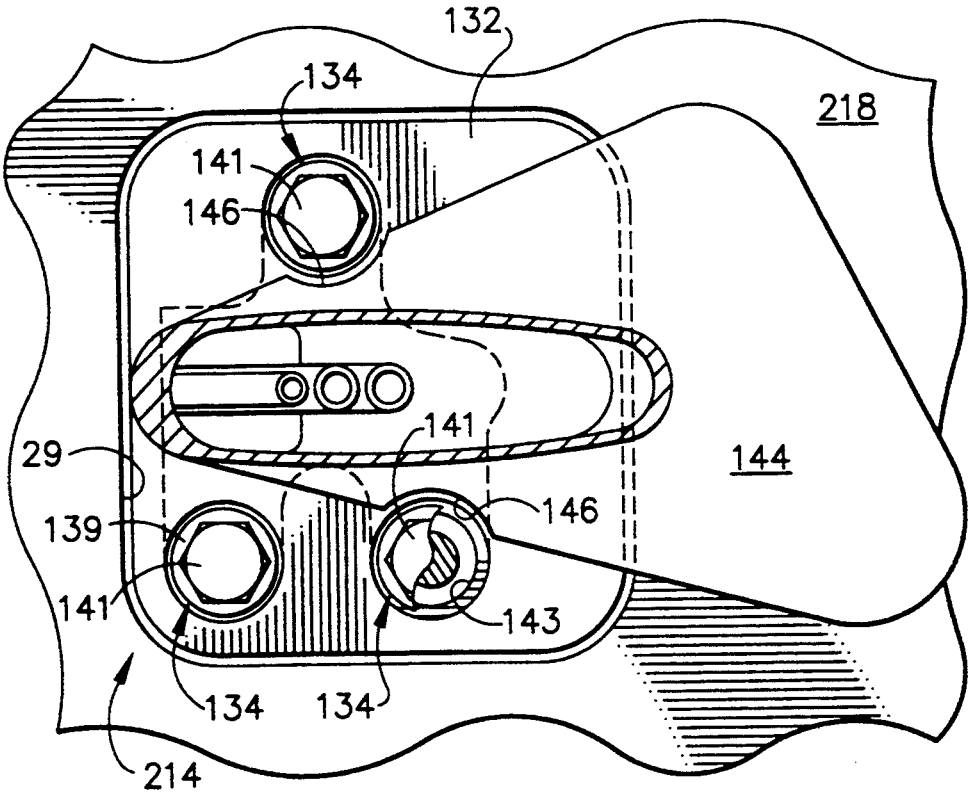
FIG. 8 is a plan view of the heat shield of FIG. 7 taken along line 8—8 of FIG. 7.
Figure 9:
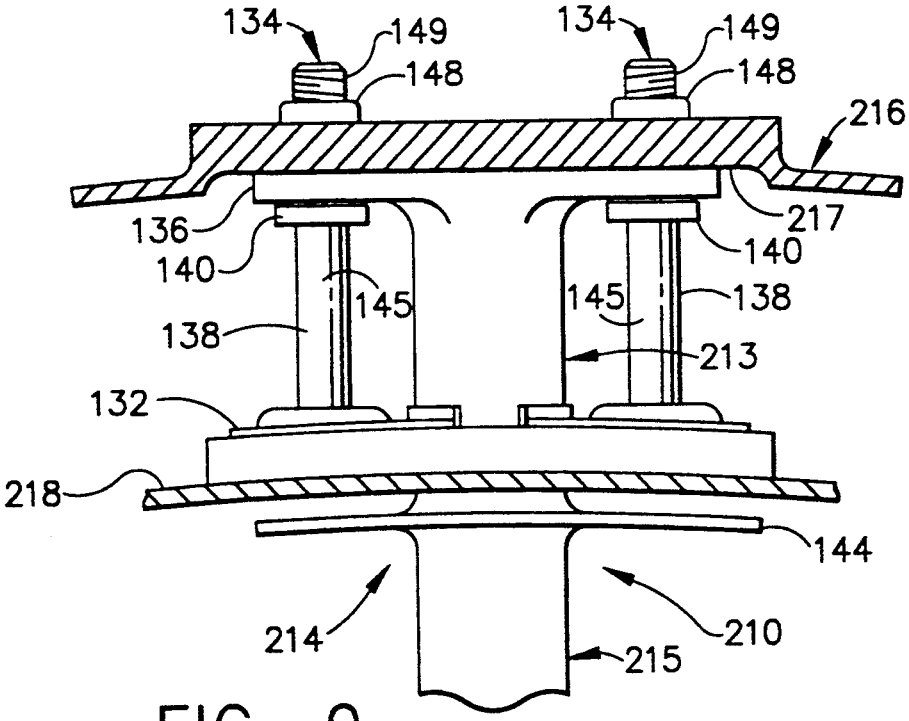
FIG. 9 is a rear elevation of the heat shield of FIG. 7 taken along line 9—9 of FIG. 7.

Another embodiment of heat shield 210 is shown in FIGS. 7, 8, and 9, with diffuser wall 218 including an aperture 29 for receiving the heat shield 210. A collar 132 is coupled, such as by brazing, to the housing 214 and maintains hot core gas flow 19 along surface 244 generally coincident with diffuser wall 218 much as the diffuser flowpath segment 44 in the aforementioned embodiments. Fasteners 134 are inserted through collar 132 to attach the housing 214, including housing second section 215, to outer duct wall 216. In this embodiment, housing first section 213 is integral with the housing second section 215 and includes an integral mounting flange 136 extending from the housing first section 213. Forward-facing opening 222 in housing first section 213 channels a portion 27 of cooling air 25 to cool fuel tube assembly 221, here depicted comprising three tubes. The mounting flange 136 is adapted to engage mounting pad 217 on the outer duct wall 216 when the fasteners 134 are installed. In the embodiment shown, the mounting pad 217 includes threaded inserts 148. A plurality of fasteners 134 comprise extended shank shoulder bolts 138, each including a bolt head 141, washer 139, shank portion 145, threaded portion 149, and a shoulder 140 for engaging the flange 136 and clamping the flange 136 to the mounting pad 217 when bolts 138 are tightened in inserts 148. The collar 132 includes a plurality of recesses 142 for receiving bolt heads 141 out of the core gas flowpath 19, defined by the diffuser wall 218. Within recess 142 is hole 143, large enough for clearance of the shoulder 140, but smaller than the face of washer 139 which is affixed to bolt head 141, thus sized to prevent the bolt 138 from entirely passing through the hole 143 during installation and removal. As shown in FIG. 8, the housing 214 is attached to the outer duct wall 216 by three bolts 138 through collar 132 in a triangular pattern. An aerodynamic fence 144 includes notches 146 for access to bolts 138 with a suitable tool, such as a hex head socket. Bolt clamping loads are not applied to the collar 132 when the heat shield 210 is installed as there is a slight clearance between washer 139 and collar 132. Loads are carried by the shoulder 140, mounting flange 136, bolt threaded portion 149, threaded inserts 148, and outer duct wall mounting pad 217. FIG. 9 is an illustration of a rear elevation of the heat shield 210 showing bolts 138 extending through collar 132 with shoulders 140 clamping flange 136 to mounting pad 217.

In each of the foregoing embodiments, the heat shield has been attached to supporting structure in such a manner that it can be removed easily and quickly from within the augmentor volume. In the embodiments depicted in FIGS. 1–6, the attachment and removal procedure requires only the tightening down or backing off of a single mounting bolt for each shield housing second section. To remove the entire housing 14 in the embodiments of FIGS. 1–5, the bolt 30 may be accessed by a suitably long-shanked tool inserted through a hole (not shown) in the diffuser wall continuation 74, through the aft leaf spring 72 or through a VABI as described in copending application filed Jan. 2, 1992, Ser. No. 07/816,694, the disclosure of which is incorporated herein by reference. Also, when installing the heat shields 14 the first time, it is a simple matter for one to reach around the open longitudinal edge 52 to access bolt 30. Likewise, the housing second section 15''' of FIG. 6 and the entire housing 214 of FIGS. 7–9 may be removed by access to bolt 30 and extended shank shoulder bolts 138, respectively, from within the augmentor channel and without requiring access from outside the outer duct wall.

It should also be noted that the attachment structure for the heat shield can be applied to other structures within the exhaust system without departing from the scope of the invention. For example, the attachment mechanism can be employed to mount a flame holder of the type disclosed in the aforementioned Gastebois U.S. Pat. No. 4,899,539, as well as Grant, Jr. 35 U.S. Pat. No. 4,989,407, the disclosures of which are incorporated herein by reference.

While the forms of apparatus herein described constitute preferred embodiments of this invention, it is to be understood that the invention is not limited to these precise forms of apparatus and that changes may be made therein without departing from the scope of the invention.

What is claimed is:

1. In a gas turbine engine of a type having an axis and including an augmentor aft of an engine core, said augmentor including at least one substantially radially-extending fuel pipe and a substantially cylindrical diffuser wall, and a generally cylindrical bypass duct for conveying cooling air to said augmentor, said duct including an outer duct wall through which said fuel pipe extends radially inwardly towards said axis, a heat shield comprising:

a hollow, elongate housing enclosing said fuel pipe substantially entirely along its length; and means for removably mounting said housing on said outer duct wall, said mounting means permitting removal of said housing by access from within said augmentor without requiring access from outside said outer duct wall.

2. The heat shield of claim 1 wherein said mounting means includes bolt means threaded substantially radially outwardly into said outer duct wall.

3. The shield of claim 2 wherein said mounting means includes a nose projecting outwardly from said housing; and said outer duct wall includes slot means for receiving said nose.

4. The heat shield of claim 3 wherein said housing is retained by engagement of said nose and said slot at a forward end of said housing and by said bolt means at an aft end of said housing.

5. The heat shield of claim 2 wherein said bolt means includes lug means shaped to engage said housing and clamp said housing against said outer duct wall when said bolt means is tightened, and wherein said housing includes a rearwardly-projecting flange shaped to be engaged by said lug means.

6. The heat shield of claim 5 wherein said outer duct wall includes a radially inwardly projecting lip; and said flange includes a recess shaped to receive said lip.

7. The heat shield of claim 1 wherein said housing includes a frustoconical portion at a radially outer end thereof; and said outer duct wall includes a complementary wedge-shaped recess; and said mounting means includes bolt means including a wedge-shaped cam at an end thereof, said cam being shaped to engage and lock said frustoconical portion against said wedge-shaped recess.

8. The heat shield of claim 7 wherein said bolt means includes a threaded boss, attached to said outer duct wall and including a guideway for said cam.

9. The heat shield of claim 1 wherein said housing includes diffuser flowpath segment means aligned substantially with said diffuser wall in said augmentor.

10. The heat shield of claim 9 wherein said diffuser flowpath segment means includes stiffener means for changing vibration characteristics of said diffuser flowpath segment means such that a natural frequency thereof is greater than tin engine operating speed.

11. The heat shield of claim 9 wherein said diffuser flowpath segment means includes opposing, axially-extending lateral edges, said lateral edges defining longitudinal slots, and said heat shield further comprises a plurality of said housings arranged in a spoke pattern such that said lateral edges of said diffuser flowpath segment means of adjacent housings abut each other; and said flowpath segment means includes spline seal segment means, mounted in said longitudinal slots, for effecting a seal between said diffuser flowpath segments.

12. The heat shield of claim 11 wherein said diffuser flowpath segment means includes a transverse edge, and a contiguous portion of said diffuser wall includes means for effecting a seal between said portion and said transverse edge.

13. The heat shield of claim 1 wherein said housing includes an opening, positioned between said outer duct wall and said diffuser wall, for receiving cooling air from said bypass duct and conveying said cooling air radially inwardly along said housing.

14. In a gas turbine engine of a type having an axis and including an augmentor aft of an engine core, said augmentor including at least one substantially radially-extending fuel pipe and a substantially cylindrical diffuser wall, and a generally cylindrical bypass duct for conveying cooling air to said augmentor, said duct including an outer duct wall through which said fuel pipe extends radially inwardly towards said axis, a heat shield comprising:

a hollow, elongate housing enclosing said fuel pipe substantially entirely along its length, with a first section substantially enclosing said fuel pipe from said outer duct wall radially inwardly to about said diffuser wall, and a second section enclosing said fuel pipe substantially entirely along its length from said first section radially inwardly; and means for removably mounting said housing second section on one of said outer duct wall and said housing first section, said mounting means permitting removal of said housing second section by access from within said augmentor and without requiring access from outside said outer duct wall.

15. The heat shield of claim 14 wherein said housing first section comprises a substantially cylindrical strut; and said mounting means mounts said housing second section to said strut.

16. The heat shield of claim 15 wherein said mounting means includes a nose projecting outwardly from said housing second section; a slot is formed in an end of said strut for receiving said nose; bolt means threaded substantially radially outwardly into said strut; and said housing second section includes a flange for receiving said bolt means therethrough.

17. The heat shield of claim 14 further comprising a collar coupled to said housing and wherein said mounting means comprises a fastener attaching said housing second section to said outer duct wall through said collar.

18. The heat shield of claim 17 further comprising said housing first section integral with said housing second section.

19. The heat shield of claim 18 further comprising said housing first section including a mounting flange adapted to engage said outer duct wall and said fastener comprising an extended shank shoulder bolt including a shoulder for engaging said flange and clamping said flange to said outer duct wall.

20. The heat shield of claim 17 wherein said collar includes a recess for receiving said fastener out of a core gas flowpath defined by said cylindrical diffuser wall.

* * * * *